United States Patent [19]

Gauthier

[11] Patent Number: 5,020,443

[45] Date of Patent: Jun. 4, 1991

[54] SKYLINE-SUSPENDED CARRIAGE FOR HEAVY LOAD PULLING

[76] Inventor: Daniel Gauthier, 16 Route 354, Saint-Gilbert, Canada

[21] Appl. No.: 452,059

[22] Filed: Dec. 18, 1989

[51] Int. Cl.[5] ..... B61B 12/00

[52] U.S. Cl. ..... 104/230; 104/112; 104/173.1; 104/178

[58] Field of Search ..... 104/173.1, 112, 176, 104/114, 178, 183, 230, 235, 238, 229, 115

[56] References Cited

U.S. PATENT DOCUMENTS

| | | | |
|---|---|---|---|
| 146,685 | 1/1874 | Jones et al. | 104/235 |
| 535,703 | 3/1895 | Lamb | 104/235 |
| 1,164,910 | 12/1915 | Ayer | 104/235 |
| 2,019,760 | 11/1935 | Mattro | 104/235 |
| 2,547,935 | 4/1951 | Grabinski | 104/235 |
| 2,927,539 | 3/1960 | Baumann | 104/235 |
| 3,012,520 | 12/1961 | Curtis | 104/235 |
| 3,606,256 | 9/1971 | Ovretveit | 104/114 |
| 3,750,591 | 7/1973 | Makinster et al. | 104/112 |
| 3,774,780 | 11/1973 | Buffington | 104/112 |
| 4,599,032 | 7/1986 | Haus, Jr. | 104/235 |
| 4,641,583 | 2/1987 | Harrington | 104/235 |

FOREIGN PATENT DOCUMENTS

| | | |
|---|---|---|
| 779081 | 2/1968 | Canada . |
| 1177010 | 10/1984 | Canada . |

*Primary Examiner*—Douglas C. Butler
*Assistant Examiner*—Mark T. Le
*Attorney, Agent, or Firm*—Pierre Lesperance

[57] ABSTRACT

A skyline-suspended carriage system for transporting a heavy load slopewisely of a hill, comprising: (a) first and second vertically-offset and horizontally spaced mobile anchor points; (b) hoists, mounted to the first and second anchor points; (c) a single skyline, partially wound around the hoists; (d) an elongated carriage having carriage suspending idle pulleys riding on the skyline and an intermediate driving pulley engaging the bottom of the skyline which is wrapped around the top sector of the driving pulley to obtain slipless engagement; and a load-grabbing and retaining dragline, wound on a hoist in the carriage. One idle pulley and the driving pulley are close together at the downhill end of the carriage while the other idle pulley is substantially spaced from the driving pulley being located at the uphill end of the carriage. This arrangement stabilizes the carriage on the skyline. The positions of the driving pulley and the dowhill idle pulley can be changed to modify the inclination of the carriage relative to the skyline depending on the slope gradient.

5 Claims, 3 Drawing Sheets

SKYLINE-SUSPENDED CARRIAGE FOR HEAVY LOAD PULLING

FIELD OF THE INVENTION

This invention relates to forestry and wood logging operations, and more particularly to a skyline transport system for transporting cut trees slopewisely of a hill and other loads.

BACKGROUND OF THE INVENTION

In wood logging operations, labour costs constitute a growing concern among operators. For instance, the slopewise transportation of tree trunks usually comprises a sky-line extending between an upper and a lower base anchor, a carriage suspended from the sky-line and a dragline extending through the carriage, then along the skyline and driven by a hoist at the upper anchor base. An operator is always required at said upper anchor base, to pay out and retrieve the drag line which serves to drag the cut trees and also to move the carriage along the skyline.

OBJECTS OF THE INVENTION

An object of the invention is to substantially reduce the labour costs associated with logging operations by eliminating the operator at the upper anchor base.

Another object of the invention is to provide a transport system in which both anchor bases are readily movable transversely of the hill to permit logging along successive slopewise zones.

SUMMARY OF THE INVENTION

The invention relates to a skyline-suspended carriage system for transporting a load slopewisely of a hill, comprising a skyline, anchored to and extending between an upper and a lower anchor point; an elongated carriage having an uphill end and downhill end, an uphill and downhill carriage suspending idle pulley mounted at the uphill and downhill ends of said carriage respectively and engaging longitudinally spaced portions of the top of the skyline, and an intermediate driving pulley mounted on said carriage for moving the carriage along the skyline, said driving pulley located adjacent said downhill idle pulley and spacedly from said uphill idle pulley and engaging the bottom of said skyline, the topmost sector of said driving pulley being higher than the straight line joining the lowermost sectors of the two idle pulleys so that the skyline is wrapped around said driving pulley through a sector of a least 30°; and power means mounted in said carriage for rotating said driving pulley.

Preferably, the system further includes a power operated hoist mounted in the carriage, a pay-out pulley carried by said carriage at its uphill end below said skyline and below said uphill idle pulley, and a drag line wound on said hoist and trained on said pay-out pulley for securing a load to be pulled by the carriage.

In the first configuration of the three pulleys, the straight line joining the axes of the drive pulley and of the downhill pulley is substantially normal to the line joining the axes of the drive pulley and of the uphill pulley. In a second configuration of the three pulleys, their axes lie on a straight line. The first configuration of the pulleys is used for a high gradient slope while the second configuration is used for a low gradient slope.

The power means preferably includes a transmission means having a drive pinion rotatably mounted in a fixed position in the carriage, and a sprocket meshing with the pinion, co-axial with and fixed to said driving pulley. The carriage further includes a first, a second and a third journal means, said first and second journal means located on a first straight line passing through the axis of said upstream idle pulley and generally extending along the top of said carriage, said second journal means disposed at a distance from the drive pinion axis equal to the distance between the drive pinion axis and said first journal means, the straight line joining the first and third journal means being generally normal to said first straight line, the axle of said driving pulley capable of being journalled in either one said first and second journal means, the axle of said downhill idle pulley capable of being selectively journalled in either one of said first and third journal means. In said first pulley configuration, said drive pulley and said downhill pulley are journalled in said first and third journal means respectively. In said second pulley configuration, said downhill pulley and said drive pulley are journalled in said first and second journal means respectively.

The invention also comprises the skyline suspended carriage system as defined above in combination with two anchor points each being a self-propelled vehicle, the lower one of said vehicles being a self-propelled power shovel including a turntable carrying a hydraulic boom provided with an end bucket adapted to abut firmly against the ground towards the direction of the skyline to prevent shovel overturning under the skyline tension, a mast extending from the boom and carrying an idle pulley on which the skyline is trained, and a hoist on the turntable on which one end of the skyline is wound.

DETAILED DESCRIPTION OF THE INVENTION

Figure 1:
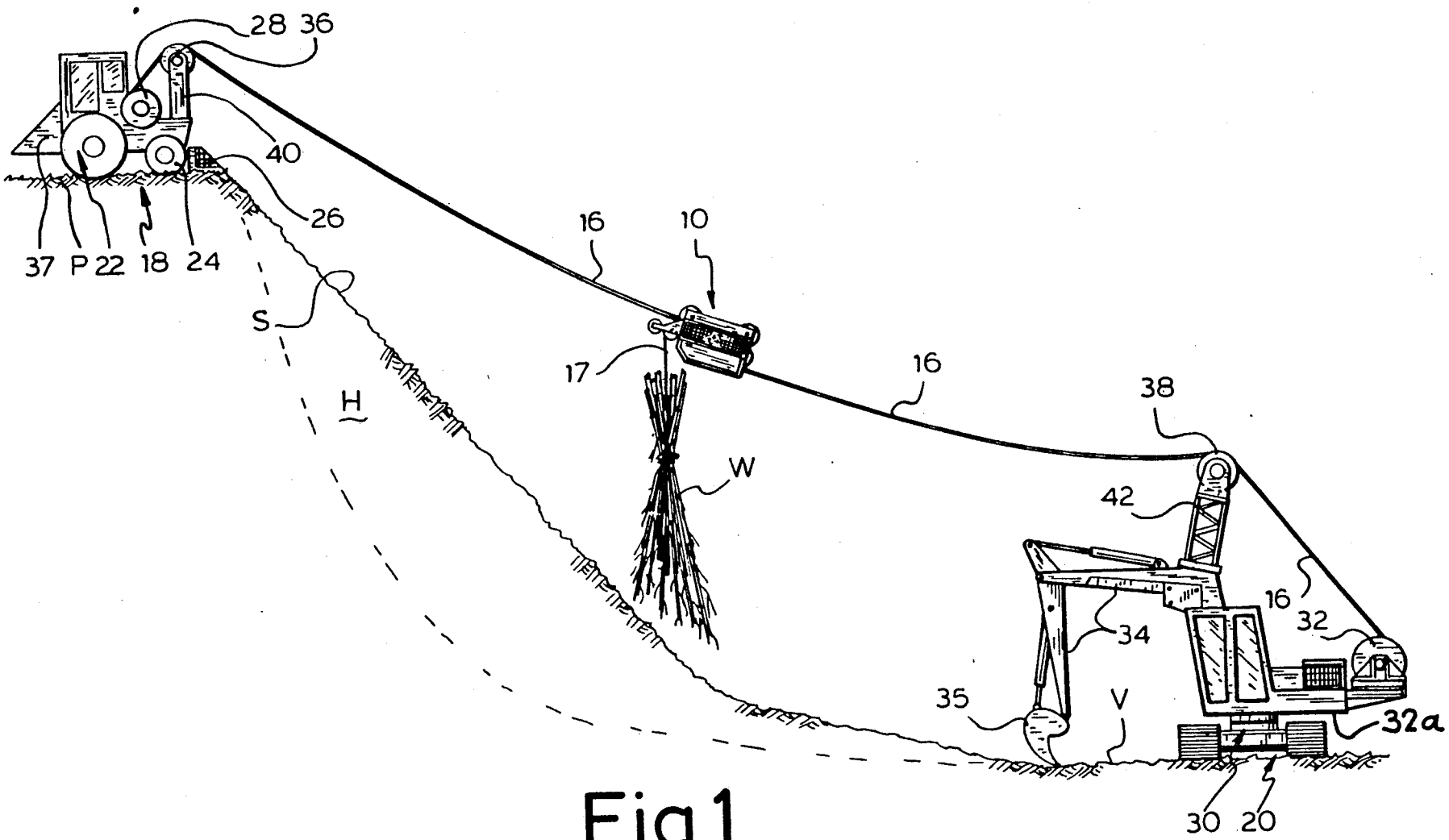
FIG. 1 is an elevational view of a load-carrying system according to the invention, spanning the slope of a hill.
Figure 2:
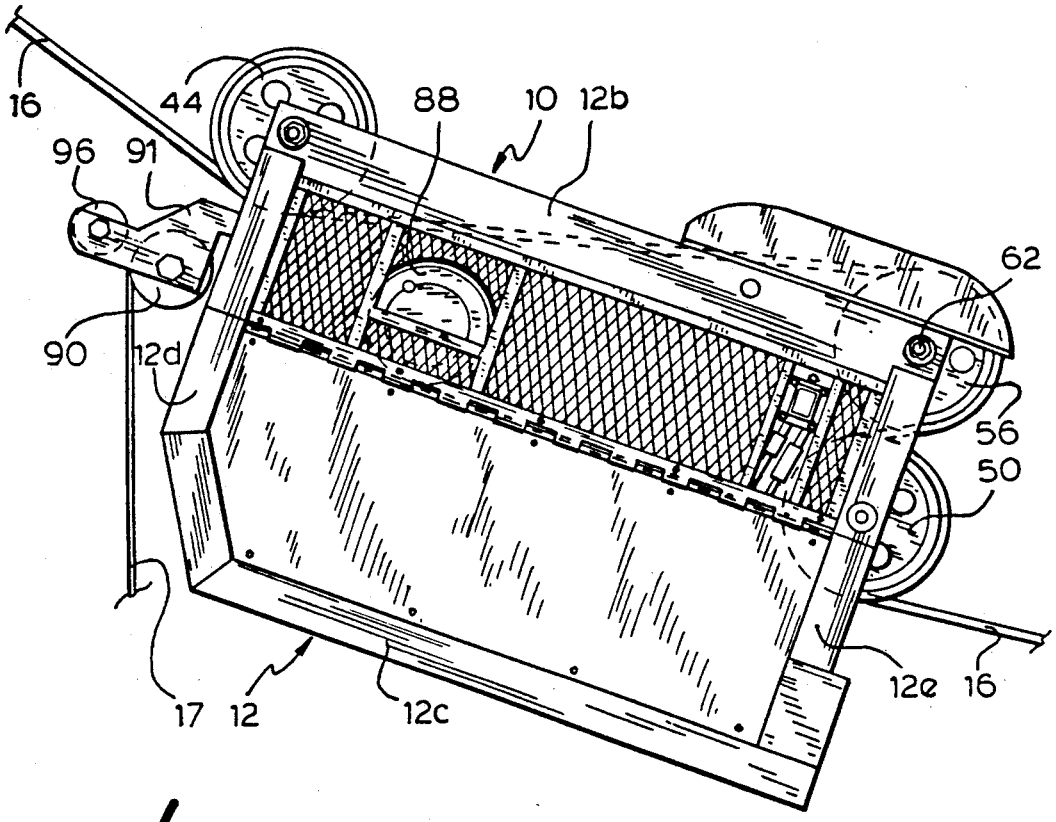
FIG. 2 is an enlarged side elevational view of the carriage of the system of the invention.

Carriage 10 consists of an elongated, rigid, box-like frame 12 through which longitudinally extends a single skyline cable 16. Cable 16 is destined to be mounted at both end sections thereof to two horizontally spaced, vertically offset, upper and lower ground anchor means, 18, 20, respectively. Mounting means, detailed later, are provided to suspend the carriage frame 12 from the cable 16, whereby the carriage frame becomes a skyline suspended carriage. A load-grabbing and retaining drag-line system, also detailed later, enables the carriage 10 to pull or carry a heavy load, e.g. a number of wooden logs or harvested trees W, via a drag-line 17, between the two anchor means 18, 20, normally downhill.

More particularly, upper anchor means 18 includes a self-propelled vehicle, e.g. a skidder 22, standing on a plateau P near the slope S of an underlying hill H. The back of skidder 22 faces the slope S, so that its rear wheels 24 be nearest to the frontward edge of plateau P while its heaviest rear part is farthest therefrom. A tree stump (not shown) or a heavy, preferably ground anchored abutment block, 26, should be installed on plateau P in front of the skidder rear wheels 24, to prevent downhill motion of skidder 22 under the load W sustained through skyline 16, as will be seen. The upper section of skyline 16 is trained on an idle pulley 36 and wound around the hoist 28 of the skidder 22. A counterweight 37 is preferably carried by the front of skidder 22 to prevent its overturning under skyline tension. It should be noted that skidder 22 can be positioned farther away from the plateau front edge than shown with skyline 16 resting on the ground at said front edge.

Lower anchor means includes another self-propelled vehicle, namely a power shovel 30 located in a valley V and in substantial register with skidder 22. The back of the turnable 32*a* of power shovel 30 carries a hoist 32, around which is wound the lower section of skyline 16. The hydraulic boom 34 of shovel 30 is positioned so that bucket 35 abuts against the ground V towards the slope S, as illustrated in the drawings, to prevent shovel overturning under skyline tension.

Idle pulleys 36, 38 engaged by skyline 16, should be carried by substantially upright masts 40, 42 upwardly projecting from the frontmost end of skidder 22 and from the elbow portion of the inner boom of shovel 30, respectively. Either one or both hoists 28, 32 can be actuated to release or tension skyline 16.

Drive means, detailed below, will enable carriage 12 to move along cable 16, between pulleys 36 and 38 and to carry a load W along or above slope S. Of course, after skyline tension has been released by rotation of hoist 28 and/or 32, the skidder 22 and/or shovel may move in the same direction transversely to the slope S in order to come in register with unlogged areas of the hill H, so as to enable the carriage 10 to reach new cut trees or logs to be brought down into the valley V.

Figure 3:
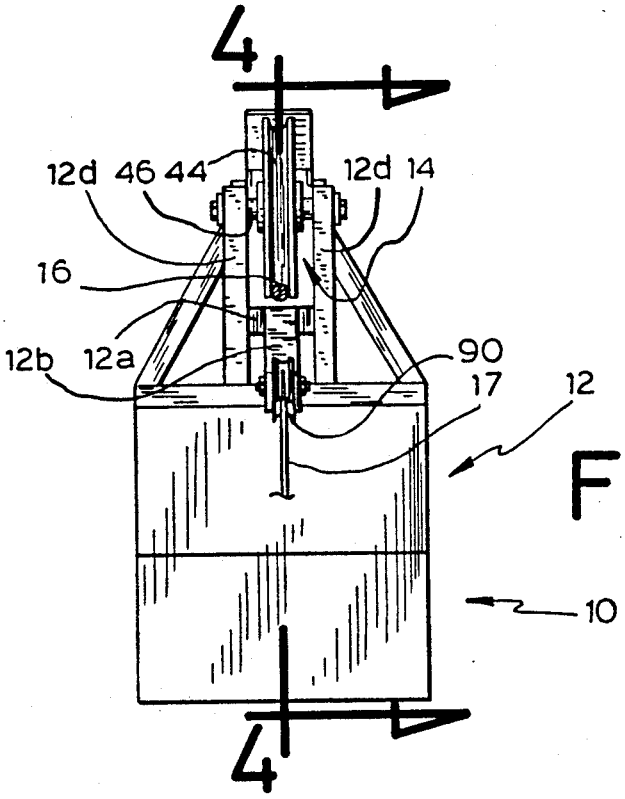
FIG. 3 is an end elevation of the carriage, taken from perspective 3 of FIG. 2.

Carriage frame 12 comprises two transversely spaced, generally rectangular frame sections rigidly interconnected by a plurality of transverse bars one of which is shown at 12*a* in FIG. 3. Each frame section comprises an upper member 12*b*, a lower member 12*c*, an upstream member 12*d* and a downstream member 12*e*.

The cable mounting means on the carriage 10 includes an uphill idle pulley 44, carried by an axle 46 mounted across the two frame sections at the corners of frame members 12*b* and 12*d*, namely at the uphill carriage end facing towards skidder pulley 36, a downhill idle pulley 50, carried by an axle 52 mounted across the two frame members 12*e*, and a drive pulley 56, fixedly secured to a drive axle 58 and mounted across the two upper frame members 12*b*. Downhill idle pulley 50 and drive pulley 56 are located close together at the downhill end of carriage 10. Carriage pulleys 44, 50, 56 must be coplanar, to enable cable 16 to engage at least a portion of the grooved rim of each of these three pulleys.

Figure 4:
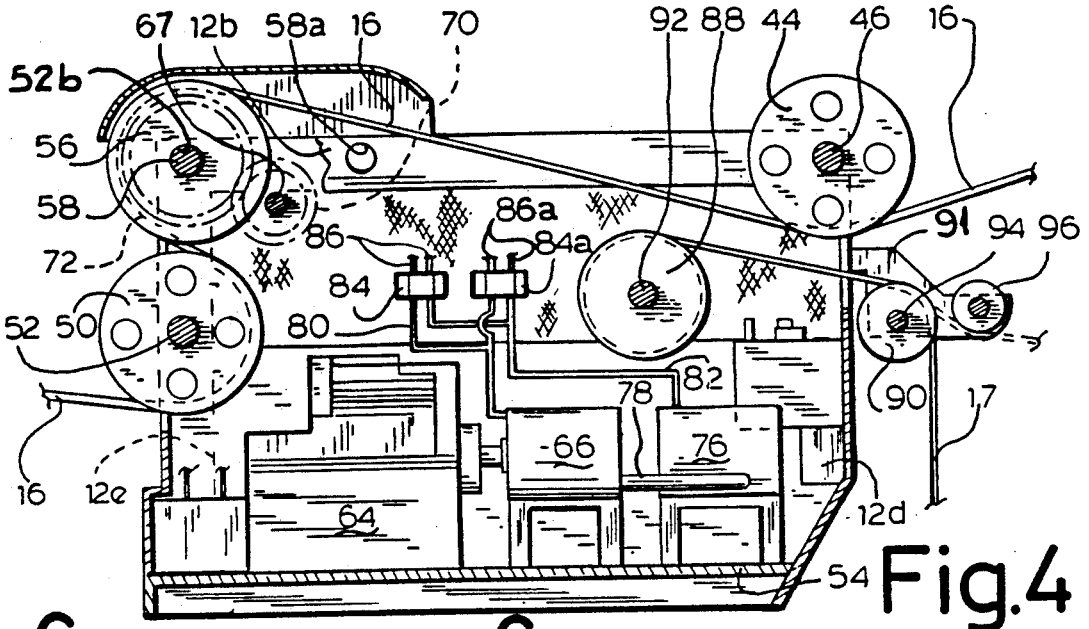
FIG. 4 is a longitudinal section taken along line 4—4 of FIG. 3.
Figure 5:
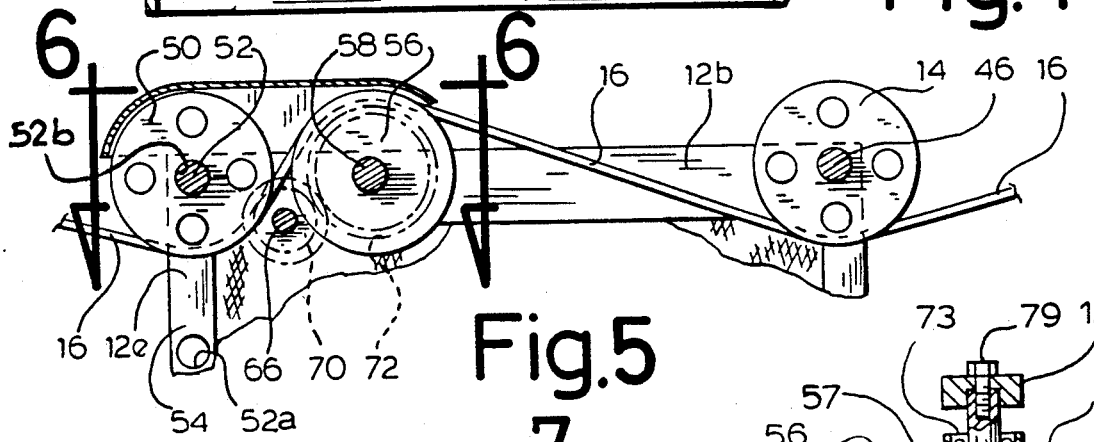
FIG. 5 is a broken view of the upper section of FIG. 4, but for a second arrangement of the sheaves, used when the system is installed on a low-gradient slope.

The relative positions of the drive pulley 56 and of the downhill idle pulley 50 can be changed as illustrated: a first position in FIG. 4, designed for high-gradient or steep slopes S; and a second one, in FIG. 5, designed for low-gradient slopes S.

In the high-gradient pulley configuration of FIG. 4, the drive axle 58 of drive pulley 56 is in a hole or journal 52*b* located at the corner of frame members 12*b* and 12*e* with downhill idle pulley 50 located close to and below drive pulley 56 with its drive axle 52 engaging the journal means indicated by holes 52*a* made in the two frame members 12*e*. The straight line joining journal holes 52*a*, 52*b* is substantially normal to the straight line joining journal holes 52*b* to the axle 46 of uphill idle pulley 44. The skyline 16 extends along the uphill half section of the rim of idle pulley 50, along the downhill half section of the rim of drive pulley 56, and tangentially of the lower rim section of uphill idle pulley 44. The cable 16 surrounds more than half the rim of drive pulley 56 for slipless engagement despite the high slope gradient. Also, the line joining the two cable sections issuing from underneath the two idle pulleys 44, 50 is upwardly inclined towards the uphill end of the carriage 10 relative to floor 54 of carriage 10. Thus, the equipment carried inside the carriage on floor 54 is maintained generally upright. In the low gradient position of FIG. 5, pulley 50 takes the former position of drive pulley 56 and the latter takes a low-gradient position with its axle 58 engaging the journal means indicated by aligned holes 58*a* in the two frame members 12*b*.

Pulley axles 46, 52, and 58 lie substantially on a straight line which extends along the top portion of carriage 10, with drive pulley 56 being located between the other two pulleys proximate idle pulley 50. Cable 16 extends along a quarter section of the lower rim section of pulley 50, along a quarter section of the upper rim section of drive pulley 56 and tangentially of the lower rim section of pulley 44.

It should be understood that switching pulleys 50, 56 from their high gradient to their low gradient position and vice versa, should be a simple operation, which can be done on the field by an unskilled worker, in a short time. Indeed, once the tension on skyline 16 is released, the nuts 62 anchoring pulley axles 52, 58 to carriage frame 12 may be unscrewed, and the axles pulled out whereby the pulleys 50, 56 can be repositioned. In the low gradient position of FIG. 5, the cable 16 has a shorter but still sufficient engagement with the drive pulley 56 for slipless drive and since the line joining the two cable sections issuing from underneath the two pulleys 44, 50 is parallel to floor 54, the equipment carried by the latter is still generally upright.

Figure 6:
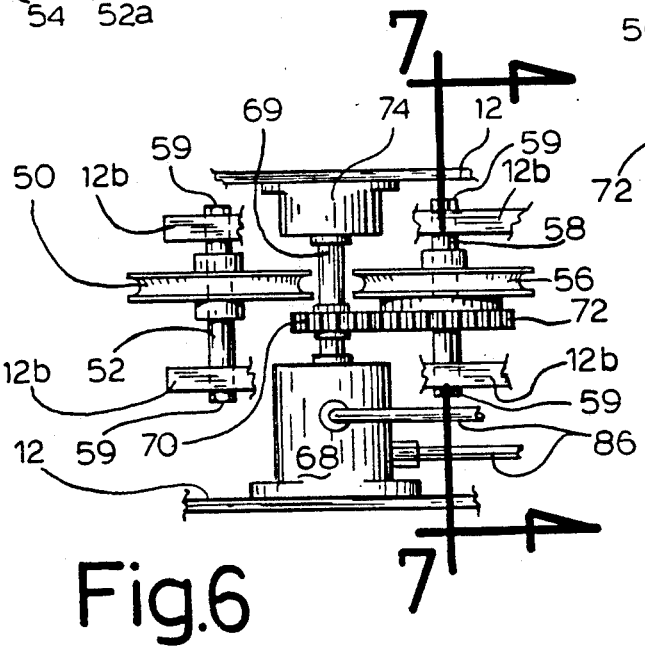
FIG. 6 is a plan view taken from perspective 6 of FIG. 5.
Figure 7:
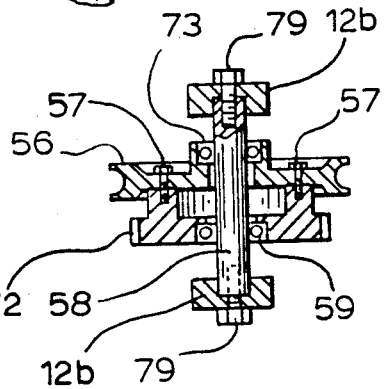
FIG. 7 is a section taken along line 7—7 of FIG. 6.

The cable drive means, shown in FIGS. 4 and 6, comprises an internal combustion engine 64, anchored to carriage floor 54 and driving a hydraulic pump 66 which drives a hydraulic motor 68, on the output shaft 69 of which is keyed the axle 67 of a pinion 70 which meshes and is coplanar with a gear wheel 72 which is fixed to drive pulley 56 by bolts 57. The assembly of pulley 56 and gear wheel 72 is rotatably mounted on a shaft 58 by bearings 73. The resulting unit is removably inserted between frame members 12*b* and shaft 58, fixed in position by bolts 59.

The position of holes 58*a* is such that gear wheel 72 meshes with pinion 70 in either position of drive wheel 56. Therefore the radial distance between holes 58*a* and the axle 67 of pinion 70 is equal to the radial distance between journal 52*b* and pinion axle 67. Preferably, an automatic safety brake means 74, of any known make, is mounted to output shaft 69, whereby upon stoppage of the feeding of pressurized fluid to hydraulic motor 68, the carriage 10 is automatically immobilized along cable 16 by the engagement of brakes 74 with shaft 69 under the bias of springs. Upon feeding of fluid under pressure to motor 68, the fluid acts against the springs and causes brake release.

Actuation of hydraulic motor 68 is made through a hydraulic circuit including a reservoir 76 connected through line 78 to the intake of pump 66. The output line 80 of pump 66 and the return line 82 to reservoir 76 are connected to a solenoid operated reversing valve 84 which controls the forward and reverse rotation of hydraulic motor 68 through motor lines 86. Brake 74 is suitably connected to lines 86. This circuit is conventional.

The load-grabbing and retaining means is shown in FIG. 4 to consist of a hydraulically operated, reversible hoist 88 and a pulley mounted on an external bracket 91 secured to the uphill end of carriage frame 12, below uphill idle pulley 44. Hoist 88 and pay-out pulley 90 have parallel axles 92, 94. Pull rope 17 is wound onto hoist 88, is trained on the upper uphill quarter rim section of pay-out pulley 90 and then hangs downwardly to be hooked at its bottom end to a load, e.g. tree trunks or wooden logs W. The hydraulic reversible motor of hoist 88 is connected by hydraulic lines 86*a* of a second electrovalve 84*a* so as to be controlled in the same way as but distinctly of drive pulley 56. Preferably, an idle roller 96 is mounted on bracket 91 at the outermost, uphill end thereof, and in spaced register with pulley 90, so as to limit the uphill play of rope 17 brought about by swinging action thereof once carriage 10 moves along. Thus, roller 96 prevents disengagement of rope 17 from pulley 90.

The two valves 84, 84*a* and preferably also the operation of engine 64 are radio-controlled in a known manner. The two idle pulleys 44, 50 support the carriage 10 on skyline 16 by engaging the top of the latter. Drive pulley engages the bottom of skyline 16, is located intermediate the two idle pulleys 44, 50 and its topmost sector is above the straight line joining the lowermost sectors of the two idle pulleys. The frictional engagement of drive pulley 56 is proportional to the tension in skyline 16 which in turn depends not only on the length and consequently weight of skyline 16, but also on the tension exerted by dragline 17 when pulling or carrying a load. Carriage 10 is stabilized against excessive swinging in the vertical plane containing skyline 16 because of the maximum spacing between the uphill idle pulley 44 and drive pulley 56 and because of the uphill position of the dragline pulley 90.

In the system of the invention, the skidder 22 needs not to be permanently manned, contrarily to systems where drag line 17 extends up the hill to the upper anchor point. The operator attaching trees to drag line 17 and radio controlling the carriage mounted hoist 88 and the carriage driving pulley 56 can operate skidder 22 to move it sideways every time he reaches the top of the hill during tree harvesting. The operators gathering the trees at the bottom of the hill look after sideways displacement of power shovel 30. Using a hoist 28, 32 at each mobile anchors provides more flexibility for displacing these anchors.

I claim:

1. A skyline suspended carriage system for moving a load, comprising a skyline anchored to and extending between an upper and a lower anchor point, an elongated carriage having an uphill and a downhill carriage suspending idle pulley mounted at the uphill and downhill ends of said carriage respectively and engaging longitudinally spaced portions of the top of the skyline, and an intermediate driving pulley mounted on said carriage for moving said carriage along the skyline, said driving pulley located nearer to said downhill idle pulley than to said uphill idle pulley and engaging the bottom of said skyline, the topmost sector of said driving pulley being higher than the straight line joining the lowermost sectors of the two idle pulleys so that said skyline is wrapped around said driving pulley through a sector of at least 30°;

and power means mounted in said carriage for rotating said driving pulley.

2. A skyline suspended carriage as defined in claim 1, further including a power-operated hoist mounted in said carriage, a pay-out pulley carried by said carriage at its uphill end, below said skyline and below said uphill idle pulley, and a dragline wound on said hoist and trained on said pay-out pulley for securing a load to be pulled by said carriage.

3. A skyline suspended carriage as defined in claim 2, wherein the straight line joining the axes of said driving pulley and said downhill pulley is substantially normal to the line joining the axes of said driving pulley and of said uphill idle pulley.

4. A skyline suspended carriage system as defined in claim 2, wherein said power means includes a transmission means having a drive pinion rotatably mounted in a fixed position in said carriage and a sprocket meshing with said pinion, co-axial with and fixed to said driving pulley and wherein said carriage further includes a first, a second and a third journal means, said first and second journal means located on a first straight line passing through the axis of said uphill idle pulley and genrally extending along the top of said carriage, said second journal means disposed at a distance from the drive pinion axis equal to the distance between the drive pinion axis and the first journal means, said third journal means located below said first journal means on a second straight line passing through said first journal means and generally normal to said first straight line, the axle of said driving pulley selectively journalled in either one of said first and second journal means, the axle of said downhill idle pulley selectively journalled in either one of said first and third journal means, the three pulleys capable of taking a high gradient pulley configuration and a low gradient pulley configuration, said downhill pulley and said drive pulley journalled in said third and first journal means respectively in said high gradient pulley configuration and journalled in said first and second journal means respectively in said low gradient pulley configuration, said sprocket meshing with said pinion in either one of said pulley configurations.

5. A skyline suspended carriage system as defined in claim 1, in combination with said anchor points, each anchor point being a self-propelled vehicle, the lower anchor point being a power shovel including a turntable carrying a hydraulic boom with an end bucket adapted to abut firmly against the ground towards the direction of the skyline to prevent shovel overturning under skyline tension, a mast upstanding from said boom and carrying an idle pulley on which said skyline is trained, and a hoist on the turntable on which one end of the said skyline is wound.

* * * * *